US005428432A

United States Patent [19]

Mitani

[11] Patent Number: 5,428,432

[45] Date of Patent: Jun. 27, 1995

[54] ELECTROPHOTOGRAPHIC RECORDING APPARATUS HAVING INTEGRATED HEATING AND COOLING DEVICE

[75] Inventor: Masao Mitani, Ibaraki, Japan

[73] Assignee: Hitachi Koki Co., Ltd., Tokyo, Japan

[21] Appl. No.: 953,224

[22] Filed: Sep. 30, 1992

[30] Foreign Application Priority Data

Oct. 2, 1991 [JP] Japan ..... 3-255537

[51] Int. Cl.[6] ..... G03G 13/20

[52] U.S. Cl. ..... 355/279; 355/327

[58] Field of Search ..... 355/279, 277, 271, 212, 355/326, 327, 282, 285, 289, 290; 219/216

[56] References Cited

U.S. PATENT DOCUMENTS

| | | | |
|---|---|---|---|
| 3,851,964 | 12/1974 | Smith et al. | 355/279 X |
| 3,937,572 | 2/1976 | Gaynor et al. | 355/217 |
| 4,073,583 | 2/1978 | Teumer et al. | 355/279 |
| 4,357,618 | 11/1982 | Ragland | 346/159 |
| 4,531,825 | 7/1985 | Miwa et al. | 355/279 |
| 4,994,858 | 2/1991 | Lubberts | 355/212 |
| 5,012,291 | 4/1991 | Buchan et al. | 355/271 |
| 5,057,875 | 10/1991 | Itoh | 355/279 X |
| 5,198,842 | 3/1993 | Fujino et al. | 346/159 |
| 5,200,285 | 4/1993 | Carrish | 355/279 X |
| 5,216,466 | 6/1993 | Mitani | 355/211 |
| 5,253,023 | 10/1993 | Hosaka et al. | 355/279 |
| 5,262,834 | 11/1993 | Kusaka et al. | 355/285 |

FOREIGN PATENT DOCUMENTS

| | | |
|---|---|---|
| 3126174 | 2/1982 | Germany . |
| 4219087 | 10/1992 | Germany . |
| 63-298381 | 12/1988 | Japan . |
| 0166966 | 6/1992 | Japan . |
| 0284481 | 10/1992 | Japan . |
| 0362983 | 12/1992 | Japan . |
| 519567 | 1/1993 | Japan . |
| 553457 | 3/1993 | Japan . |

*Primary Examiner*—Robert B. Beatty

*Attorney, Agent, or Firm*—Sughrue, Mion, Zinn, Macpeak & Seas

[57] ABSTRACT

An electrophotographic recording apparatus in which a thin endless metal belt having a photoconductive photosensitive layer on an outer circumferential surface is provided around a drive roller and an integrated heating and cooling unit, and rotated by the drive roller. A latent electrostatic image forming device (a corona charger and an exposing unit) is disposed adjacent to the outer circumferential surface of the metal belt that is near the drive roller, and a developing device is disposed downstream from the latent electrostatic image forming device adjacent the heating and cooling unit, so that a toner image formed on the metal belt by both devices is transferred and fixed while sequentially brought into pressure contact with a member to which to transfer the toner image. In another embodiment a multi-color electrophotographic recording apparatus is provided in which multi-color toner images are formed on the metal belt using at least two pairs of image forming and developing devices, each pair including a latent electrostatic image forming device and a developing device as in the above-mentioned electrophotographic recording apparatus. The multi-color toner images are then transferred to and fixed on the member by the integrated heating and cooling unit. The integrated heating and cooling unit includes a cooling member, a heater embedded in the cooling member and an insulating member interposed between the heater and cooling member.

7 Claims, 2 Drawing Sheets

ELECTROPHOTOGRAPHIC RECORDING APPARATUS HAVING INTEGRATED HEATING AND COOLING DEVICE

BACKGROUND OF THE INVENTION

1. Field of the Invention

The invention relates to electrophotographic recording apparatus such as copying machines, facsimile machines, printers, and systems combining these machines and printers.

2. Description of Related Art

In the field of output devices of computers and personal computers and copying machines for copying images, a system of recording data by electrophotography is extensively employed to produce hard copies quickly and inexpensively. Particularly, low-speed apparatus characterized by a relatively low-speed recording are rapidly gaining in popularity in recent years, and are expanding their market share due to excellent maintainability achieved by employing a cassette having a developing unit and a cleaner disposed around a photosensitive drum.

However, the cassette requires replacement of many components, such as the photosensitive drum, the developing unit, and the cleaner, in addition to toner that is the only thing which needs to be replenished in conventional apparatus. This brings about a shortcoming in that the running cost of the apparatuses with the cassette is several times as high as that of the conventional ones.

SUMMARY OF THE INVENTION

Therefore, an object of the invention is to provide an electrophotographic recording apparatus which is downsized, inexpensive, highly sophisticated, and reduced in the number of main components.

The above object invention has been achieved by the provision of an electrophotographic recording apparatus, which comprises: a thin endless metal belt having a photoconductive photosensitive layer around the outer circumferential surface thereof, which is rotated while installed onto a drive roller and an integrated heating and cooling unit; a latent electrostatic image forming means and a developing means for forming a toner image with toner which are disposed adjacent to the outer circumferential surface of the photosensitive metal belt that is near the drive roller, so that a toner image formed on the photosensitive metal belt by these means is transferred and fixed while sequentially brought into pressure contact with a member to which to transfer such toner image.

Further, the above object of the invention has been achieved by the provision of a multi-color electrophotographic recording apparatus, which comprises: a thin endless metal belt having a photoconductive photosensitive layer around the outer circumferential surface thereof, which is rotated while installed onto a plurality of drive rollers and a single integrated heating and cooling unit; a plurality of latent electrostatic image forming means and a plurality of developing means for forming toner images with toners of different colors which are disposed adjacent to the outer circumferential surface of the photosensitive metal belt that is near each driver roller, so that toner images formed on the photosensitive metal belt by these means are transferred and fixed while sequentially brought into pressure contact with a member to which to transfer such toner image with the integrated heating and cooling means.

In the above-mentioned apparatus, offset-free fixation is possible by biasing the integrated heating and cooling unit onto the member to which to transfer a toner image from behind the photosensitive metal belt carrying the toner image, cooling after fusing and fixing the toner image onto the member, and separating the member from the photosensitive metal belt at the time the fused toner has been increased sufficiently.

The heating and cooling time is shortened, and the heating and cooling unit is small and integrated due to the effective application of a metal having a predetermined heat conductivity that is used as a base material for the photosensitive belt.

In the above-mentioned apparatus, the material for the photosensitive layer formed on the photosensitive metal belt of the invention must be resistant to high temperatures (e.g., 130° C.) during fixation and must maintain a surface condition whose adhesiveness with toner is low.

A downsized multi-color electrophotographic recording apparatus can be achieved by forming multicolor toner images on the photosensitive metal belt while providing two or more sets of means, each set consisting of a latent electrostatic image forming means and a developing means of the above-mentioned component-reduced, downsized electrophotographic recording apparatus, and transferring and fixing the toner images onto a member to which to transfer the toner images using the integrated heating and cooling unit.

DETAILED DESCRIPTION OF THE PREFERRED EMBODIMENTS

First, in order to overcome the above-described problems, the inventor made inventions for which Japanese Patent Applications Nos. 66366/1991 and 160215/1991 were filed. Each invention is directed to a novel electrophotographic recording system involving the steps of: electrostatically transferring a latent electrostatic image to a photosensitive drum to a dielectric layer coated over an endless metal belt; developing such transferred image with toner to form a toner image; and fusing, transferring, and fixing the toner image onto a member to which to transfer the toner image while bringing an integrated heating and cooling unit into pressure contact with the member from inside the metal belt.

These inventions reduced the number of maintenance parts in electrophotographic recording apparatus to toner only, which is a consumable good, thereby contributing not only to a significant economic saving but also to an environmental improvement with a great reduction of wastes.

As is apparent from the following description, the present invention is characterized as further reducing the number of major components compared with the inventions disclosed in the above-mentioned Japanese Patent applications. In other words, the present invention is characterized as integrating the photosensitive drum and the dielectric metal belt disclosed in the above-mentioned Japanese Patent applications into the photosensitive metal belt, which allowed further reduction in the number of components.

Embodiments of the invention will now be described with reference to the accompanying drawings.

EXAMPLE 1

Figure 1:
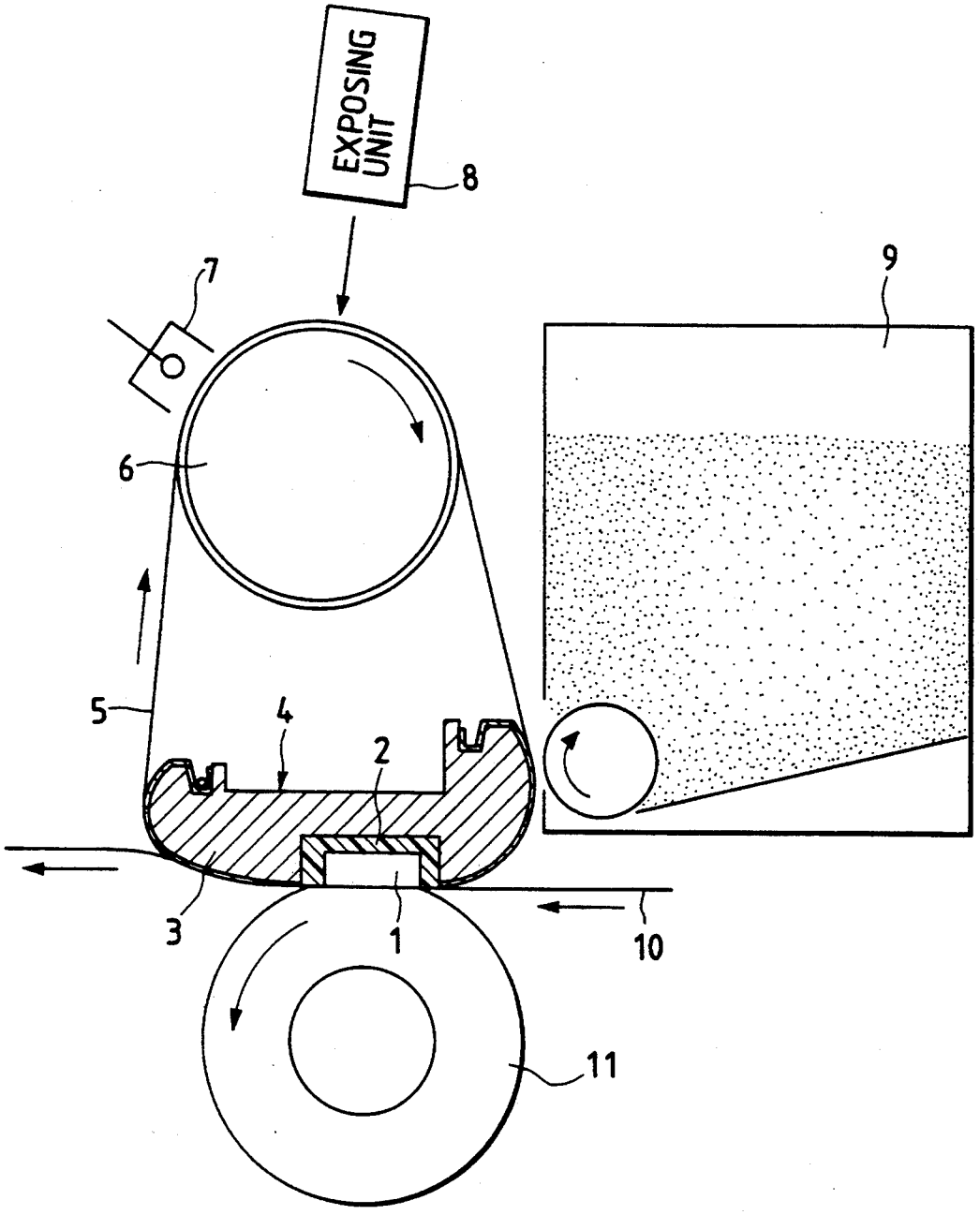
FIG. 1 is a sectional view showing an electrophotographic recording apparatus according to an embodiment of the invention.

FIG. 1 is a sectional view showing an electrophotographic recording apparatus, which is an embodiment of the invention. A thin endless metal belt (hereinafter referred to as "photosensitive metal belt") 5 having a photoconductive photosensitive layer on the outer circumferential surface thereof is installed onto a drive roller 6 and an integrated heating and cooling unit 4 so that the photosensitive metal belt 5 can be rotated to drive a pressure roller 11 that is brought into pressure contact with the heating and cooling unit 4.

The integrated heating and cooling unit 4 is basically the same as those disclosed in other Japanese patent applications submitted by the inventors (Japanese Patent Applications Nos. 293986/1990, 339079/1990, 49392/1991, 211269/1991, 66366/1991, and 160215/1991).

More specifically, the integrated heating and cooling unit 4 includes: a cooling structure 3, a heater 1 embedded in the cooling structure 3 at a position confronting the pressure roller 11, and an insulating body 2 interposed between the heater 1 and the cooling structure 3. Since the cooling structure 3 is made of a heat-conductive material such as aluminum, the photosensitive metal belt 5 heated by the heater 1 is cooled quickly by the cooling structure 3 disposed at an outlet side.

The photosensitive metal belt 5 uses as a base material an endless nickel metal belt of about 30 μm in thickness prepared by electroforming. That is, a laminated organic photosensitive layer is formed on the base material of the outer circumferential surface of the endless nickel metal belt in the following fashion.

A coating solution was prepared by dissolving one part by weight of a polyamide resin ("M-1276" (trade name) manufactured by Nippon Rirusan Co., Ltd.) and one part by weight of a melamine resin ("Melan 2000" (trade name) manufactured by Hitachi Chemical Co., Ltd.) into 100 parts by weight of a mixed solvent prepared by mixing 1,1,2-trichloroethane and ethanol at a ratio of 3 to 2 as an underlayer material. This underlayer material was coated over the endless nickel metal belt by dipping, and the thus prepared coating was dried at 120° C. for one hour to form a 0.2 μm thick underlayer.

Then, 2.5 parts by weight of $\tau$-type metal-free phthalocyanine (manufactured by Toyo Ink Mfg. Co., Ltd.) was dispersed for eight hours using a ultrasonic cleaner, together with 95 parts by weight of tetrahydrofuran (manufactured by Wako Junyaku Kogyo Co., Ltd.) and 2.5 parts by weight of a silicone resin (manufactured by Shin-Etsu Chemical Co., Ltd.) as an electric charge generating layer material. The obtained dispersed solution was coated over the underlayer by dipping and dried at 140° C. for one hour to form a 0.3 μm thick electric charge generating layer.

Then, 6 parts by weight of stilbene, 9 parts by weight of the silicone resin (manufactured by Shin-Etsu Chemical Co., Ltd.), and 0.02 parts by weight of a silane coupling agent (manufactured by Shin-Etsu Chemical Co., Ltd.) were dissolved and dispersed into 85 parts by weight of tetrahydrofuran as an electric charge carrying layer material. The obtained dispersed solution was coated over the electric charge generating layer by dipping. The coating was then dried at 140° C. for one hour to form a 20 μm thick electric charge carrying layer.

A toner image could be formed by an ordinary method using the thus prepared photosensitive metal belt 5. That is, the belt 5 was negatively charged uniformly by a corona charger 7 as shown in FIG. 1, so that an exposing unit 8 could form a latent electrostatic image and then a developing unit 9 could transform the latent electrostatic image into a toner image. The toner image formed on the photosensitive metal belt 5 could be fused, transferred, and fixed onto a recording sheet 10 simultaneously from behind the photosensitive metal belt 5 using the integrated heating and cooling unit 4, as in the inventions disclosed in the above-mentioned patent applications (Japanese Patent Applications Nos. 66366/1991 and 160215/1991).

The only point that distinguishes this example from the inventions disclosed in the above-mentioned patent applications is that the photosensitive drum is provided separately from the metal belt in the latter whereas the photosensitive metal belt 5 incorporates the function of the photosensitive drum so that a merit of downsizing the device is achieved in this example.

When the recording sheet 10 was separated from the photosensitive metal belt 5, the temperature of the photosensitive metal belt 5 was reduced to 80° C. or less by the cooling structure 3. As a result, no offset of toner toward the metal belt 5 was observed. The use of the nonadhesive silicone resin as a base resin in the outermost layer of the photosensitive layer also accounts for the absence of offset. It is assumed that the cancelling out of positive charges on the toner and negative charges on the photosensitive layer also contributes to the success.

Since the photosensitive metal belt 5 is designed so that its temperature falls about 50° C. at the time the photosensitive metal belt 5 separates from the cooling structure 3, no abnormality was detected on the photosensitivity of the photoconductive photosensitive layer of the photosensitive metal belt 5.

Also, no abnormality was found for up to 20,000 recording sheets (A4 size) in recording life tests, verifying that heat resistance of the photosensitive material forming the photoconductive photosensitive layer of the photosensitive metal belt 5 was sufficient. The toner used in the tests was of a low melting point type (whose fixing temperature is 130° C.). The tests were conducted by setting the maximum temperature of the photosensitive metal belt 5 to 130° to 140° C.

Phthalocyanine serving as the electric charge generating agent and stilbene serving as the electric charge carrying agent, which are photosensitive materials used in the above embodiment, are considered excellent in heat resistance among materials for these agents. The base resin serving as the dispersing agent for these agents was a silicone resin exhibiting the highest heat resistance among conventionally known base resins. In addition, silicone resins are the best material for exhibiting nonadhesiveness. It is said that the glass transition point of the silicone resin is 220° to 240° C. and that the long-term heat resistance temperature is 180° C.

Although not noticeable in the above embodiment, "filming by toner" appeared on the photosensitive surface. This depends on the type of toner used, and can be removed by cleaning the photosensitive surface. The use of an erase lamp is also effective.

EXAMPLE 2

An example in which a resin having a low glass transition point is used as a base resin is described below, the base resin being used as a photosensitive material for the photosensitive metal belt 5.

In a manner similar to Example 1, a 0.2 μm thick underlayer was arranged on the outer surface of the nickel metal belt, and phthalocyanine (the same material as in Example 1) and a polycarbonate resin (manufactured by Mitsubishi Gas Chemical Co., Ltd.) were mixed at a ratio of 1 to 1 to form a 0.2 μm thick electric charge generating layer. Further, stilbene and the silicon resin were mixed at a ratio of 2 to 3 to form a 20 μm electric charge carrying layer in a manner similar to Example 1 on the electric charge generating layer. Then, recording tests were conducted using the same toner as in Example 1. The same results as in Example 1 were obtained in all respects.

The glass transition point of the polycarbonate resin in this example ranges from about 140° to 150° C. Although the glass transition point may present some problem in terms of heat resistance, the thickness of the film was as thin as 0.2 μm, thereby allowing the 20 μm thick silicone resin layer formed thereon to lessen the pressure of the pressure roller 11 completely. It is for these reasons that the satisfactory results were obtained.

EXAMPLE 3

Recording tests were conducted under the same conditions as in Example 2 except that a polyvinyl butyral resin was used instead of the polycarbonate resin.

The results of the recording tests indicated deterioration in printing characteristics up to 1000 to 2000 recording sheets. It is assumed that the glass transition point of the polyvinyl butyral resin, which is about 80° C., and fatigue due to repetitive pressuring at high temperatures (up to 140° C.) accounted for such deterioration.

EXAMPLE 4

Recording tests were conducted under the same conditions as in Example 1 except that a polyether sulfone resin was used instead of the silicone resin serving as the base resin for the electric charge carrying layer.

In this case, as expected, toner offset was so large that the toner could not be removed satisfactorily by cleaning. To overcome this problem, recording tests were conducted again after coating a trifluoride resin (Shin-Etsu Chemical Co., Ltd.) in a thickness of about 2 μm on the electric charge carrying layer as an overcoat layer. This was effective in controlling toner offset.

While the inventors were concerned about the amount of electric charges stored in the overcoat layer when conducting the tests for this example, no problem was presented. It is assumed that the electric charges on the toner during fusion and fixation and the electric charges stored on the overcoat layer were neutralized.

While the trifluoride resin layer is semitransparent, a drop in sensitivity was checked to a slight extent with the layer being 2 μm in thickness.

EXAMPLE 5

Figure 2:
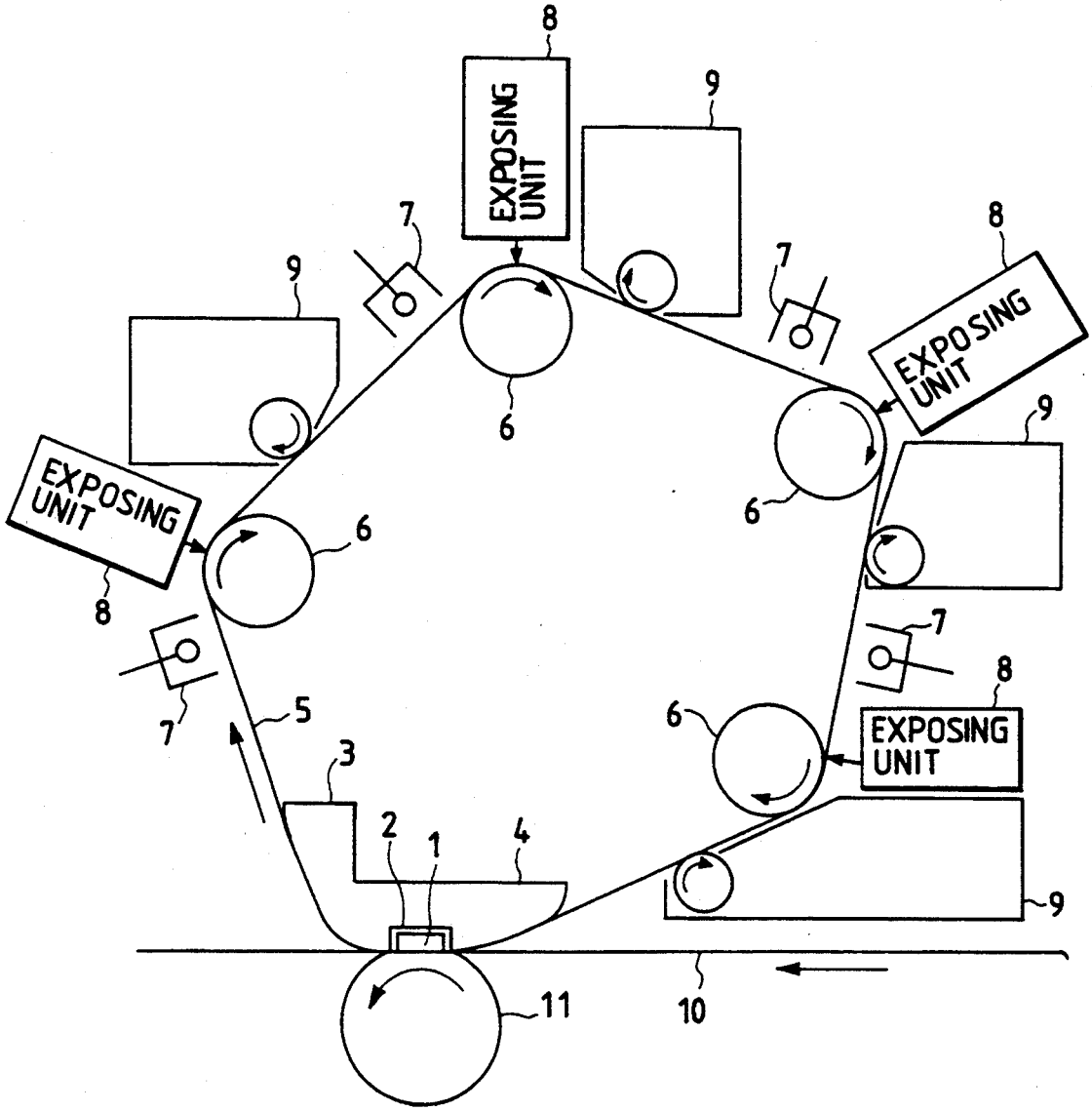
FIG. 2 is a sectional view showing a full-color electrophotographic recording apparatus according to another embodiment of the invention.

FIG. 2 is a sectional view showing a full-color electrophotographic recording apparatus according to another embodiment. The apparatus of FIG. 2 is substantially the same in configuration as that of FIG. 1 except that four sets of drive rollers 6, corona chargers 7, exposing units 8 and developing units 9 are arranged instead of one set. That is, as shown in FIG. 2, a photosensitive metal belt 5 whose configuration is the same as that of FIG. 1 is installed onto four drive rollers 6 and a single integrated heating and cooling unit 4 so that the photosensitive metal belt 5 can be rotated to drive a pressure roller 11 that is brought into pressure contact with the heating and cooling unit 4. The apparatus also includes four corona chargers 7, four exposing units 8 for forming latent electrostatic image and four developing units 9 for forming toner images with toners of different colors which are disposed adjacent to the outer circumferential surface of the photosensitive metal belt that is near each drive roller 6, so that toner images formed on the photosensitive metal belt 5 are transferred and fixed while sequentially brought into pressure contact with a member to which to transfer such toner image with the integrated heating and cooling unit 4.

The apparatus shown in FIG. 2 is directed to a full (four) color electrophotographic recording apparatus, however, it goes without saying that the apparatus can be designed for an electrophotographic recording apparatus handling two or three colors.

A first feature of Example 5 is that transfer and fixing of color toner images can be completed simultaneously. A second feature is that occurrence of color mismatching among color toner images can be minimized. The photosensitive metal belt 5 is relatively rigid and allows latent electrostatic images to be formed in a desired position. Accuracy in color matching during multicolor image forming depends on accuracy in position control of the rotating photosensitive metal belt 5, and accuracy in position control can be maintained within the order of ±10 μm with ease.

To keep the image quality of full-color printing over a long period of time, cleaning of the photosensitive metal belt after transfer and fixing was found to be effective.

As described in the foregoing pages, the invention achieves a further reduction of components compared with the inventions disclosed by the inventors in their patent applications (Japanese Patent Applications Nos. 66366/1991 and 160215/1991). That is, the integration of the photosensitive drum and the dielectric metal belt into the photosensitive metal belt contributes to reducing the components respectively related thereto.

The achievement of the downsized and inexpensive apparatus has opened the way to achieving a downsized and inexpensive full-color electrophotographic recording apparatus.

What is claimed is:

1. An electrophotographic recording apparatus, comprising:

a drive roller;

an integrated heating and cooling means;

a photosensitive metal belt including a thin endless metal belt base, and a photoconductive photosensitive layer formed around an outer circumferential surface of said thin endless metal belt base, said photosensitive metal belt being provided around said drive roller and said integrated heating and cooling means, said photosensitive metal belt being rotated by said drive roller;

means for forming a latent electrostatic image on said photosensitive metal belt; and means for developing said latent electrostatic image with toner to form a toner image on said photosensitive metal belt, said forming means and developing means being disposed adjacent to said outer circumferential surface of said photosensitive metal belt at portions near said drive roller and said integrated heating and cooling means, respectively;

wherein said integrated heating and cooling means brings said toner image formed on said photosensitive metal belt into pressure contact with a member to which a toner image is to be transferred to transfer and fix said toner image to said member, and wherein said integrated heating and cooling means comprises a cooling member made of metal, a heater in contact with said belt and embedded in said cooling member at a position confronting a pressure roller, and an insulating member interposed between each interface of said heater and said cooling member.

2. A multi-color electrophotographic recording apparatus comprising:

a plurality of drive rollers, an integrated heating and cooling means, a photosensitive metal belt including a thin endless metal belt base and a photoconductive photosensitive layer formed around an outer circumferential surface of said thin endless metal belt base, said photosensitive metal belt being provided around said plurality of drive rollers and said integrated heating and cooling means, said photosensitive metal belt being rotated by said plurality of drive rollers;

a plurality of forming means for forming latent electrostatic images on said photosensitive metal belt; and a plurality of developing means for developing said latent electrostatic images with toners of different color to form multicolor toner images, a pair of each of said plurality of forming means and each of said plurality of developing means being disposed adjacent to said outer circumferential surface of said photosensitive metal belt at positions upstream and downstream, respectively, of each of said plurality of drive rollers;

wherein said integrated heating and cooling means sequentially brings said multi-color toner images formed on said photosensitive metal belt into pressure contact with a member to which a toner image is to be transferred to transfer and fix said multicolor toner images to said member, and wherein said integrated heating and cooling means comprises a cooling member made of metal, a heater in contact with said belt and embedded in said cooling member at a position confronting a pressure roller, and an insulating member interposed between each interface of said heater and said cooling member.

3. An electrophotographic recording apparatus, comprising:

a drive roller;

an integrated heating and cooling means;

a photosensitive metal belt including a thin endless metal belt base, and a photoconductive photosensitive layer formed around an outer circumferential surface of said thin endless metal belt base, said photosensitive metal belt being provided around said drive roller and said integrated heating and cooling means, said photosensitive metal belt being rotated by said drive roller, said photosensitive layer includes a base resin having a glass transition point which is higher than a softening point of the toner;

means for forming a latent electrostatic image on said photosensitive metal belt; and means for developing said latent electrostatic image with toner to form a toner image on said photosensitive metal belt, said forming means and developing means being disposed adjacent to said outer circumferential surface of said photosensitive metal belt at portions near said drive roller and said integrated heating and cooling means, respectively;

wherein said integrated heating and cooling means brings said toner image formed on said photosensitive metal belt into pressure contact with a member to which a toner image is to be transferred to transfer and fix said toner image to said member, and wherein said integrated heating and cooling means comprises a cooling member made of metal, a heater in contact with said belt and embedded in said cooling member at a position confronting a pressure roller, and an insulating member interposed between each interface of said heater and said cooling member.

4. A multi-color electrophotographic recording apparatus comprising:

a plurality of drive rollers, an integrated heating and cooling means, a photosensitive metal belt including a thin endless metal belt base and a photoconductive photosensitive layer formed around an outer circumferential surface of said thin endless metal belt base, said photosensitive metal belt being provided around said plurality of drive rollers and said integrated heating and cooling means, said photosensitive metal belt being rotated by said plurality of drive rollers, said photosensitive layer includes a base resin having a glass transition point which is higher than a softening point of the toner;

a plurality of forming means for forming latent electrostatic images on said photosensitive metal belt; and a plurality of developing means for developing said latent electrostatic images with toners of different color to form multi-color toner images, a pair of each of said plurality of forming means and each of said plurality of developing means being disposed adjacent to said outer circumferential surface of said photosensitive metal belt at positions upstream and downstream, respectively, of each of said plurality of drive rollers;

wherein said integrated heating and cooling means sequentially brings said multi-color toner images formed on said photosensitive metal belt into pressure contact with a member to which a toner image is to be transferred to transfer and fix said multicolor toner images to said member, and wherein said integrated heating and cooling means comprises a cooling member made of metal, a heater in contact with said belt and embedded in said cooling member at a position confronting a pressure roller, and an insulating member interposed between each interface of said heater and said cooling member.

5. An electrophotographic recording apparatus, comprising:

a photosensitive belt;

means for forming a latent electrostatic image on said photosensitive belt;

means for developing said latent electrostatic image with toner to form a toner image on said photosensitive belt;

integrated heating and cooling means, for placing said toner image into pressure contact with a recording surface to transfer and fix said toner image to said surface, said integrated heating and cooling means comprising a heater which is in contact with said belt and embedded in a cooling member made of metal and an insulating member disposed between each interface of said heater and said cooling member so that said heater does not contact said cooling member.

6. An electrophotographic recording apparatus, comprising:

a drive roller;

an integrated heating and cooling means;

a photosensitive metal belt including a thin endless metal belt base, and a photoconductive photosensitive layer formed around an outer circumferential surface of said thin endless metal belt base, said photosensitive metal belt being provided around said drive roller and said integrated heating and cooling means, said photosensitive metal belt being rotated by said drive roller;

means for forming a latent electrostatic image on said photosensitive metal belt; and means for developing said latent electrostatic image with toner to form a toner image on said photosensitive metal belt, said forming means and developing means being disposed adjacent to said outer circumferential surface of said photosensitive metal belt at portions near said drive roller and said integrated heating and cooling means, respectively;

wherein said integrated heating and cooling means brings said toner image formed on said photosensitive metal belt into pressure contact with a member to which a toner image is to be transferred to transfer and fix said toner image to said member, and wherein said integrated heating and cooling means comprises a cooling member made of metal, a heater which is in contact with said belt and embedded in a member inlet side of said cooling member, and an insulating member interposed between said heater and said cooling member.

7. A multi-color electrophotographic recording apparatus comprising:

a plurality of drive rollers, an integrated heating and cooling means, a photosensitive metal belt including a thin endless metal belt base and a photoconductive photosensitive layer formed around an outer circumferential surface of said thin endless metal belt base, said photosensitive metal belt being provided around said plurality of drive rollers and said integrated heating and cooling means, said photosensitive metal belt being rotated by said plurality of drive rollers;

a plurality of forming means for forming latent electrostatic images on said photosensitive metal belt; and a plurality of developing means for developing said latent electrostatic images with toners of different color to form multi-color toner images, a pair of each of said plurality of forming means and each of said plurality of developing means being disposed adjacent to said outer circumferential surface of said photosensitive metal belt at positions upstream and downstream, respectively, of each of said plurality of drive rollers;

wherein said integrated heating and cooling means sequentially brings said multi-color toner images formed on said photosensitive metal belt into pressure contact with a member to which a toner image is to be transferred to transfer and fix said multi-color toner images to said member, and wherein said integrated heating and cooling means comprises a cooling member made of metal, a heater which is in contact with said belt and embedded in a member inlet side of said cooling member, and an insulating member interposed between said heater and said cooling member.

* * * * *